US008240986B1

(12) United States Patent
Ebert

(10) Patent No.: US 8,240,986 B1
(45) Date of Patent: Aug. 14, 2012

(54) TURBINE INTER-STAGE SEAL CONTROL

(75) Inventor: Todd A. Ebert, West Palm Beach, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 1189 days.

(21) Appl. No.: 12/004,950

(22) Filed: Dec. 21, 2007

(51) Int. Cl.
*F04D 29/08* (2006.01)

(52) U.S. Cl. ..... 415/173.2; 415/174.1; 415/230

(58) Field of Classification Search ..... 415/173.2, 415/173.7, 174.1, 140, 136, 229, 230; 277/359, 277/360, 387, 389
See application file for complete search history.

(56) References Cited

U.S. PATENT DOCUMENTS

| | | | | |
|---|---|---|---|---|
| 4,344,736 | A | 8/1982 | Williamson | |
| 5,399,065 | A | 3/1995 | Kudo et al. | |
| 5,609,466 | A | 3/1997 | North et al. | |
| 5,758,487 | A | 6/1998 | Salt et al. | |
| 6,099,244 | A | 8/2000 | Tomita et al. | |
| 6,152,685 | A * | 11/2000 | Hagi | 415/14 |
| 6,761,529 | B2 | 7/2004 | Soechting et al. | |

* cited by examiner

*Primary Examiner* — Dwayne J White
(74) *Attorney, Agent, or Firm* — John Ryznic

(57) ABSTRACT

A turbine inter-stage seal with active clearance control. The inner diameter of the stator vane includes a seal support structure with a plurality of segmented seal supports each movable by an actuator located on the vane outer diameter with a plunger or push rod extending through the hollow portion of the vanes. A segmented seal arrangement, such as segmented brush seals, are secured to the underside of the seal support segments and form a complete annular seal for the inter-stage between adjacent rotor disks. A proximity probe or microwave sensor detects the brush seal clearance, and a controller regulates the brush seal clearance.

9 Claims, 2 Drawing Sheets

TURBINE INTER-STAGE SEAL CONTROL

BACKGROUND OF THE INVENTION

1. Field of the Invention

The present invention relates generally to a gas turbine engine, and more specifically to an inter-stage seal in a gas turbine engine.

2. Description of the Related Art Including Information Disclosed Under 37 CFR 1.97 and 1.98

In a gas turbine engine, a turbine converts the energy from a hot gas flow into mechanical energy used to drive the compressor and, in the case of an industrial gas turbine (IGT), to drive an electric generator for power production. A typical IGT turbine includes four stages of stator vanes and rotor blades to progressively extract the energy from the hot gas flow.

In the multiple stage turbine with rotating blades and stationary vanes or stators, inter-stage seals are used on the inner diameter of the stator to form a seal between the rotating blades and the stationary vanes. The seal is exposed to a pressure differential which is identical to that created by the acceleration of the flow between stator vanes. Flow which leaks across this seal affects the performance of the engine in several ways. First, the leakage affects the aerodynamic design of the turbine and also makes it difficult to control the turbine rim cavity purge using expensive compressor bleed air to the minimum required to avoid hot gas ingestion. Large inter-stage seal clearance ultimately leads to over purged turbine cavities which further reduce engine performance by not being able to extract work from the compressor bleed air. A well designed system minimizes the leakage across the inter-stage seal to satisfy rim cavity purge and rotor cooling requirements. While many newer types of contacting and non-contacting seals exist to run tight at steady state conditions, the concern is seal wear during transient operation.

The rotor and stator systems are not perfectly thermally matched so the transient thermal response of the stator does not match that of the rotor. This will cause either wear on seals that are assembled tight, or on seals which are not allowed to contact, will require the steady state clearance at base load to be opened due to the transient close down which are most severe during warm restarts.

An ideal solution to this problem is to have the rotor and stator thermally matched so the stator thermally grows identical to the rotor and the clearance is a function of mechanically induced displacement. Cold or assembly clearances can be built identical to the mechanical growth of the rotor. This would make the seal clearance effectively zero or line to line and would offer the particular seal its lowest flow consumption. This type of system would be classified as passive clearance control. In particular, the rotors are usually large compared to stators and would require adding mass to the stator or changing the external environment of the casing. In aircraft engines, this approach is prohibitive due to weight constraints. Other approaches to passive clearance control would be to use seal support materials which have a low coefficient of thermal expansion in combination with spring like stator designs to absorb the relative motion between the stator and the lesser moving seal support.

The prior art U.S. Pat. No. 6,761,529 B2 issued to Soechting et al on Jul. 13, 2004 and entitled COOLING STRUCTURE OF STATIONARY BLADE, AND GAS TURBINE discloses an inter-stage seal in a turbine. However, this seal is not controlled. The seal gap between the rotor and the stator only changes due to thermal mismatches.

BRIEF SUMMARY OF THE INVENTION

The object of the present invention is to provide for an improved inter-stage seal in a turbine.

Another object of the present invention is to provide for an active clearance control for an inter-stage seal in a turbine.

An active clearance control for a gas turbine inter-stage seal in which an annular arrangement of segmented inter-stage seal supports is supported on the vane inner shroud side of the vane. Each inter-stage seal segment is connected by a plunger that is passed through the vane to an actuator. Segmented brush seals are supported on the inter-stage seal segments and form an annular brush seal to provide the seal between the rotor stages. The actuator moves each inter-stage seal segment in a radial direction to control the brush seal position with respect to the seal surface on the rotor disks. A proximity probe or microwave sensor is used to detect the brush seal clearance and regulate the actuator to control the clearance during engine transients and steady state operation to reduce brush seal or other types of seal wear.

DETAILED DESCRIPTION OF THE INVENTION

Figure 1:
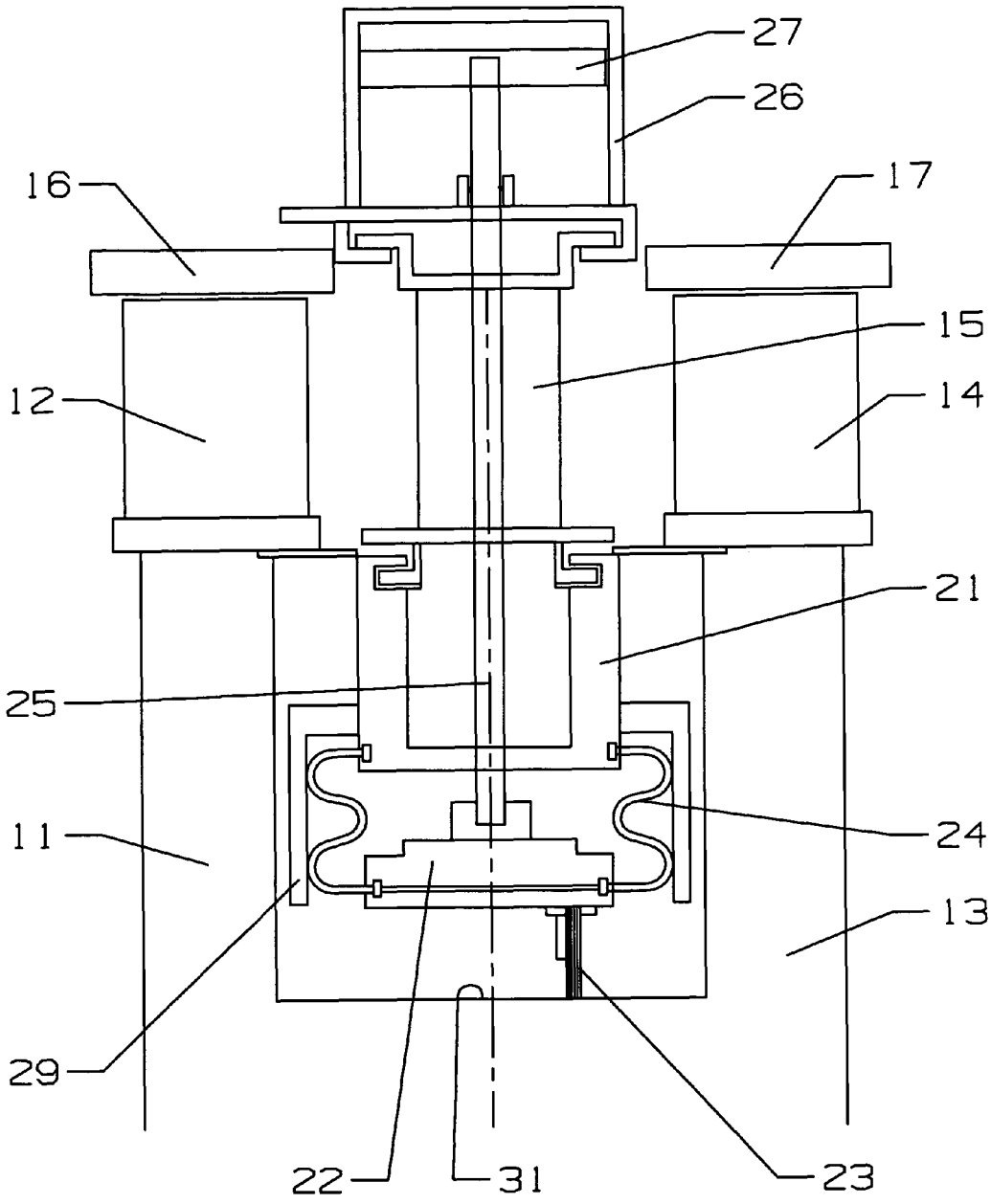
FIG. 1 shows a cross section view of the inter-stage seal of the present invention.

The mechanical actuated inter-stage seal clearance control apparatus of the present invention is shown in FIG. 1 for an inter-stage seal between a first rotor disk 11 and a second rotor disk 14. A first stage turbine blade 12 is secured onto the first rotor disk 11 and a second stage rotor blade 14 is secured onto the second rotor disk 13. A second stage vane 15 is positioned between the two rotor blades and includes a fluid actuator 26 on the outer diameter end to control the inter-stage seal clearance. Non-fluid actuators, such as an electric or mechanical actuator, can also be used to move the plunger. A piston 27 reciprocates within the actuator housing 26 and is connected to a plunger or piston rod 25 that is passed through the hollow interior of the vane 15. Outer shroud segments 16 and 17 are arranged around the rotor blade tips to form a flow path for the hot gas flow through the turbine. The two rotor disks form a sealing surface 31 underneath the inter-stage seal. The inter-stage seal with the active clearance control of the present invention can be used with any stage vane located between two rotor disks.

An annular seal support 21 is supported on the inner diameter of the vanes. In this embodiment, the annular seal support is 180 degrees so that two of these are used to form the complete annular seal support around the rotor disks. The plunger 25 passes through a hole formed in the annular seal support 21 and is connected to a segmented seal holder 22. In this embodiment, there is one segmented seal holder for each vane. However, in other embodiments there can be one segmented seal holder for two or more vanes. A flexible seal support spring 24 is annular in shape and is connected on the outer diameter end to the annular seal support 29 and on the inner diameter end to the segmented seal holder 22. In the present embodiment, two annular flexible seal support springs of about 180 degrees each form together a complete 360 degrees annular spring assembly Annular T-shaped slots are formed in the sides of the seal support 21 and the seal holder 22 in which similar shaped ends of the seal support spring 24 are supported Annular guide rails 29 extend around the seal support spring 24 and function as guides to prevent the seal support spring 24—and therefore the segmented seal holders 22—from shifting in an axial direction. In the present embodiment, two annular guard rails of about 180 degrees each are used to form the complete 360 degree annular guard rail assembly. An annular brush seal assembly is secured to the underside of the seal holders 22 to provide the seal between the two rotor disk stages.

Figure 2:
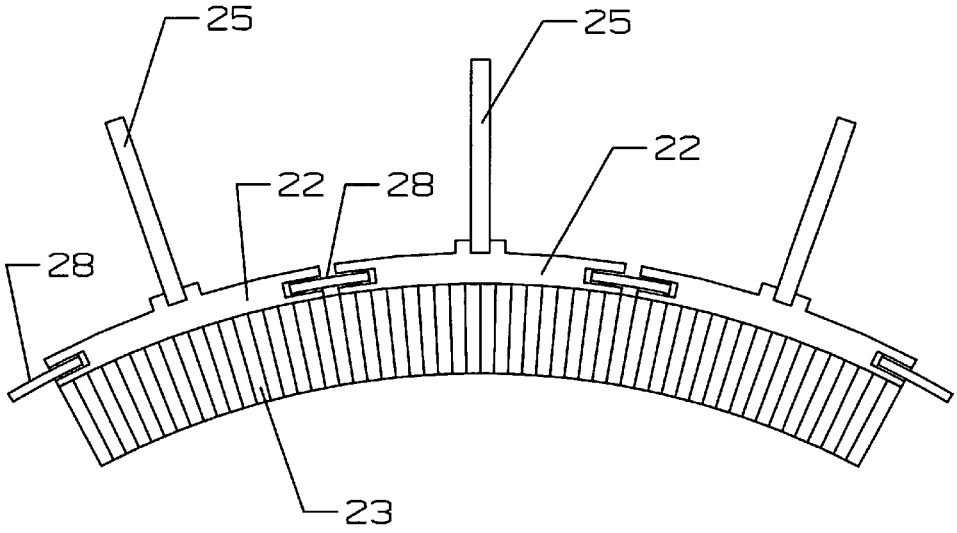
FIG. 2 shows a front view of three adjacent inter-stage seal segments with the brush seal and the actuator plunger.

FIG. 2 shows a front view of three adjacent seal support segments 22 each connected to a plunger 25. Because the seal supports 22 can be moved in the radial direction, the spacing between adjacent seal supports 22 can change. Thus, spline seals 28 are inserted into slots of adjacent seal support segments 22 to provide a seal between the segments and allow for changes in the spacing between the segments. Each segment 22 includes a brush seal segment 23 secured to the underside. The adjacent sides of the brush seal segments 23 includes ship lap shaped ends to allow for the spacing to change without allowing for an opening to occur between adjacent brush seal segments.

In this embodiment, a brush seal is used to provide the seal between the stationary vane and the rotating rotor disks. However, other seals can be used that are capable of varying the gap. For example, knife edge seals or labyrinth seals can be used as well as non-contacting hydrodynamic seals such as finger seals or hybrid brush seals.

In operation, the brush seal positioning relative to the sealing surface formed between the two rotor disks 11 and 13 can be controlled by moving the piston 27 enclosed within the actuator housing 26 by regulating the fluid pressure applied to the piston end chamber and/or the rod end chamber of the actuator housing 26. The actuator fluid can be pneumatic or hydraulic fluid powered, or an electric driven actuator. However, compressed air is used in this embodiment. As the piston 27 moves, the seal holders 22 are moved because of the rigid plunger 25. A proximity probe or a microwave sensor is used to detect the position of the brush seal with respect to the seal surface 31 on the rotor disks, and the regulation of the fluid pressure to the actuator housing is controlled based upon the probe or sensor reading. Thus, an active clearance control for the inter-stage seal is produced in the gas turbine engine. Because the inter-stage seal can be controlled to account for changes in the seal spacing due to transient or steady state loading of the engine, seal wear is greatly reduced which eliminates hot gas ingestion from the high pressure side of the vane through the inter-stage seal and into the low pressure side.

The number of seal support segments 22 can vary from one for each vane to as little as eight to form the complete annular support for the brush seals. Enough seal support segments are needed so that the inner annular surface remains substantially annular is shape when the segments are moved in the radial direction and the spacing between adjacent segments varies. Also, the individual segments 22 must be adequately supported for movement in the radial direction without twisting or turning so that the brush seal segments maintain the proper sealing with the rotating sealing surface 31 on the rotor disks.

The flexible seal support spring 24 is shown as a bellows type annular spring. The purpose for the seal support spring is to maintain a closed fluid flow path through the brush seal and to allow for the radial movement of the seal support segments 22. The inter-stage seal with the active clearance control of the present invention can be used with any stage vane located between two rotor disks and not only the second stage vane as described in the above embodiment. The present invention can also be easily incorporated into prior art gas turbine engines that do not have actively controlled inter-stage seals but only passive controlled inter-stage seals.

I claim the following:

1. A gas turbine engine comprising:

a forward rotor disk and an aft rotor disk, the two disks forming a seal surface for an inter-stage seal;

a stator vane positioned between the rotor blades of the two rotor disks;

an inter-stage seal formed between the inner diameter of the stator vane and the sealing surface of the two rotor disks;

an actuator operatively connected to the inter-stage seal control a clearance of the inter-stage seal; and, the actuator includes a plunger passing through the stator vane.

2. The gas turbine engine of claim 1, and further comprising:

a plurality of segmented seal holders;

an actuator connected to each of the segmented seal holders; and, a brush seal segment secured on the underside of the segmented seal holders.

3. The gas turbine engine of claim 2, and further comprising:

a spline seal held within slots of adjacent segmented seal holders, the spline seal maintaining a seal between adjacent segments as a spacing between adjacent segments changes.

4. The gas turbine engine of claim 2, and further comprising:

adjacent brush seal segments include a ship lap to prevent an opening from forming between adjacent brush seal segments when the seal holder segments are displaced in a radial direction.

5. The gas turbine engine of claim 1, and further comprising:

sensor means to detect a position of the inter-stage seal; and,

Control means to displace the inter-stage seal in a radial direction.

6. An inter-stage seal comprising:

a first rotor disk and a second rotor disk, both rotor disks being rotatably secured together;

a first set of blades associated with the first rotor disk;

a second set of blades associated with the second rotor disk;

a stator vane assembly secured to a non-rotating part and positioned between the first rotor disk and the second rotor disk and blades to guide the fluid from the first rotor blades to the second rotor blades;

the inter-stage seal formed between the stator vane assembly and the two rotor disks;

a plurality of segmented seal holders;

an actuator connected to each of the segmented seal holders to displace the associated segment in a radial direction;

a seal segment secured onto an inner surface of the segmented seal holders;

the actuators are located near an outer diameter of the stator vane assembly; and, a plunger is connected between the actuator and the segmented seal holder, the plunger passes through a hollow interior of the vane.

7. The inter-stage seal of claim 6, and further comprising: guide means to limit an axial displacement of the segmented seal holders while allowing for radial displacement of the segmented seal holders.

8. The inter-stage seal of claim 7, and further comprising: the guide means also provides for a seal means to prevent inter-stage seal leakage from passing into the vane interior.

9. The inter-stage seal of claim 6, and further comprising: the seal segments are brush seal segments with overlapping ends to limit passage of fluid across the brush seal assembly.

* * * * *